United States Patent [19]

Papandrea et al.

[11] Patent Number: 4,543,806

[45] Date of Patent: Oct. 1, 1985

[54] RETRACTABLE CABLE LOCK

[75] Inventors: James J. Papandrea, 10202 W. Hayes, West Allis, Wis. 53227; John L. Wenger, Milwaukee, Wis.

[73] Assignee: James J. Papandrea, West Allis, Wis.

[21] Appl. No.: 515,016

[22] Filed: Jul. 18, 1983

[51] Int. Cl.[4] ..... E05B 37/06

[52] U.S. Cl. ..... 70/30; 70/303 R; 242/107.2; 242/107.6

[58] Field of Search ..... 70/25, 26, 30, 49, 59, 70/57, 58, 14, 303 R, 314–317, 319; 242/107, 107.2, 107.6

[56] References Cited

U.S. PATENT DOCUMENTS

| | | | |
|---|---|---|---|
| 3,906,758 | 9/1975 | Hurwitt | 70/30 |
| 4,037,441 | 7/1977 | Ray | 70/49 X |
| 4,044,577 | 8/1977 | Horlacher | 70/49 X |
| 4,086,795 | 5/1978 | Foster et al. | 70/49 X |
| 4,125,231 | 11/1978 | Henderson | 242/107 |

FOREIGN PATENT DOCUMENTS

| | | | |
|---|---|---|---|
| 1933381 | 1/1971 | Fed. Rep. of Germany | 70/30 |

*Primary Examiner*—Gary L. Smith
*Assistant Examiner*—Russell W. Illich
*Attorney, Agent, or Firm*—Andrus, Sceales, Starke & Sawall

[57] ABSTRACT

A portable, hand-holdable, retractable cable lock includes a cable-carrying spool rotatably mounted within a casing. The cable extends through the casing and its free end may be locked to the casing to provide a theft deterrent. A coil spring within the casing applies a retracting force on the spool so that when the cable is unlocked and in an extended position the spring automatically rotates the spool to rewind the cable thereon. A ratchet mechanism permits free rotation of the spool in one direction to extend the cable, but prevents rotation of the spool in its other direction to rewind the cable unless disengaged.

1 Claim, 5 Drawing Figures

RETRACTABLE CABLE LOCK

BACKGROUND OF THE INVENTION

The present invention relates to locks, and more particularly to an extendable cable lock providing a theft deterrent device for locking garments, bikes, skis, luggage and many other items.

Various arrangements are known for locking garments, skis, luggage and the like to provide a theft deterrent. Some of these devices are shown in U.S. Pat. Nos. 4,069,691, 3,885,674 and 51,524. These devices, however, are not portable and are designed solely for use in locking garments. Although U.S. Pat. No. 1,326,584 shows a portable locking device, it's extendable cable is not automatically retractable. Thus, there remains a need for a multi-purpose lock that is lightweight and compact so that it can be carried in the pocket of a coat, jacket, pants or purse.

SUMMARY OF THE INVENTION

A portable, hand-holdable, retractable cable lock providing a multi-purpose theft deterrent device which is lightweight, compact and inexpensive to manufacture.

The retractable cable lock includes a casing and a spool rotatably mounted within the casing. The casing includes a pair of annular cup-shaped cap members each having a circumferential rim adapted to be in interfitting engagement with one another when the cap members are assembled. The spool includes a cylindrical core and a pair of opposing spaced apart annular retaining plates defining an area therebetween upon which a cable may be wound. The spool is mounted for free rotational movement relative to the casing.

Locking means is provided for locking the free end of the cable to the casing. The locking means includes an elongate member at the cable's free end adapted to cooperate with tumbler means within the casing.

A coil spring located within the casing has one end attached to the spool and its other end attached to the casing. When the cable is unlocked and extended, the coil spring applies a retracting force on the spool to rotate the spool and automatically rewind the cable thereon.

The cable lock further includes latch means for permitting free rotation of the spool in one direction to extend the cable, but preventing free rotation of the spool in its other direction to rewind the cable unless disengaged. The latch means includes a ratchet wheel disposed within the casing, a pawl member pivotally mounted on the side of the casing for engagement with the ratchet wheel, and a ratchet spring for normally biasing one end of the pawl into engagement with the ratchet wheel.

The cable lock also includes first and second annular thin discs disposed within the casing coaxially with the spool. The discs are disposed on either side of the spool to provide a means for reducing friction when the spool is rotated within the casing.

The present invention thus provides a portable, hand-holdable, retractable cable lock which provides a multi-purpose theft deterrent device.

BRIEF DESCRIPTION OF THE DRAWINGS

The drawings illustrate the best mode presently contemplated of carrying out the invention.

In the drawings

DESCRIPTION OF THE PREFERRED EMBODIMENT

Figure 1:
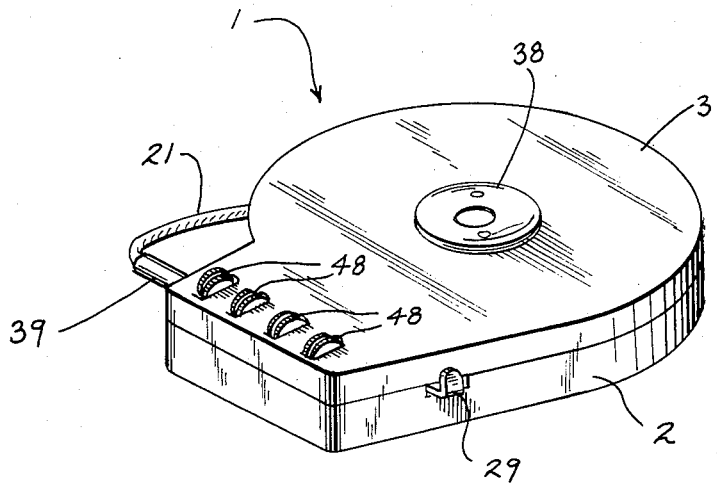
FIG. 1 is a perspective view of a retractable cable lock constructed in accordance with the principles of the present invention.

Referring now to the drawings, FIG. 1 illustrates a retractable cable lock generally designated by the numeral 1 constructed in accordance with the principles of the present invention. Cable lock 1 may be utilized as a multi-purpose lock for bikes, skis, luggage, garments such as coats and jackets, and many other items for quick and easy anti-theft security. Cable lock 1 is portable, hand-holdable, lightweight and compact so that it can be easily carried in the pocket of a coat, jacket, pants or purse.

Figure 2:
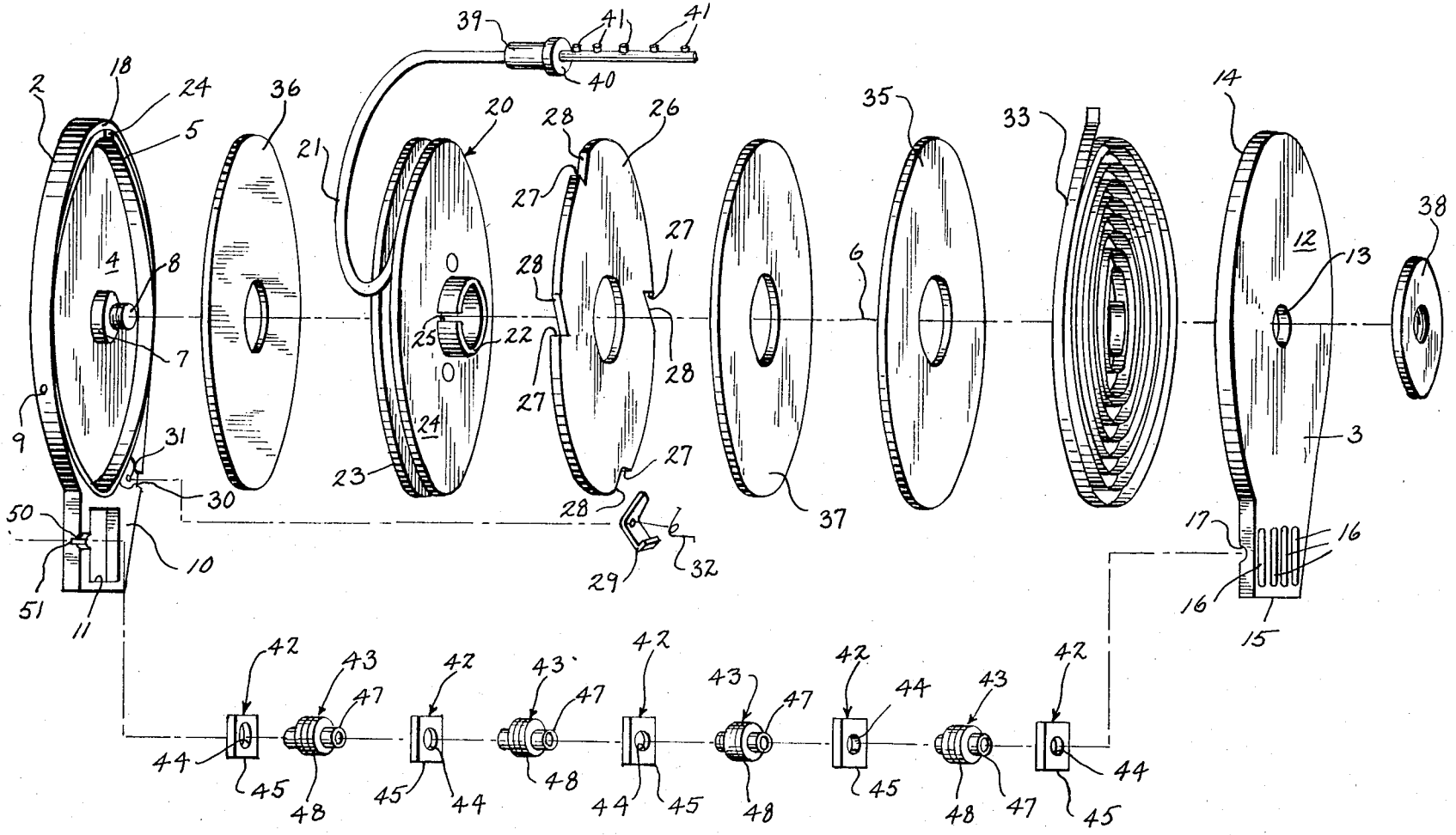
FIG. 2 is an exploded view showing the arrangement of the components for the retractable cable lock of FIG. 1.

Referring now to FIG. 2, cable lock 1 includes an outer casing having a pair of annular, cup-shaped cap members 2 and 3 for housing the remaining components of lock 1. Bottom cap member 2 includes an annular, flat base plate 4 and a circumferential outer rim 5 projecting from the inner side of base 4 to be concentric with a central axis designated in FIG. 2 by the numeral 6. A circular boss 7 projects inwardly from the inner side of base 4 and includes a threaded stud 8 of lesser diameter both of which are located coaxially with respect to axis 6. As shown best in FIG. 3, rim 5 includes a bore 9 formed therethrough the purpose of which will hereinafter be described. Cap member 2 also includes an enlargement having a rectangular shaped recess 11 formed therein and a semicircular bore 50 communicating between recess 11 and the outer surface of enlargement 10. Bore 50 also includes a radially extending notch 51 which extends from the outer surface of enlargement 10 to recess 11.

To cap member 3 also includes an annular, flat base plate 12 having a central opening 13 formed therethrough for receiving stud 8, and a circumferential outer rim 14 extending inwardly from the inner side of base 12 to be concentric with central opening 13 and axis 6. Cap member 3 further includes an enlargement 15 having four elongated slots 16 formed therethrough and a semicircular bore 17 communicating between the outer surface of member 3 and its adjacent slot 16. As seen best in FIG. 2, rim 5 of cap member 2 includes an annular shoulder 18 formed therein. The surface of shoulder 18 is coplanar with the inner surface of enlargement 10 so as to permit interfitting engagement with rim 14 and enlargement 15. Thus, when assembled rim 5 embraces rim 14 and shoulder 18 engages the end of rim 14 to provide a smooth mating relationship between cap members 2 and 3. It should also be noted that when assembled semicircular bores 17 and 50 form a circular bore the purpose of which will hereinafter be described.

As shown in FIG. 2, cable lock 1 includes a spool 20 on which is stored a length of cable 21. Spool 20 inbludes a cylindrical core 22 and a pair of opposing, parallel, spaced apart annular retaining plates 23 and 24 thereon defining an area therebetween for storing the length of cable 21 about core 22. The outer circumference of plates 23 and 24 lie substantially adjacent to the inner circumference of rim 5 so that the diameter of plates 23 and 24 is substantially identical to the diameter of the annular chamber defined by cap members 2 and 3. The inner diameter of the central opening in core 22 is substantially equal to the outer diameter of boss 7 so that core 22 receives boss 7 therein to provide free rotational movement of spool 20 relative to cap members 2 and 3. As shown best in FIG. 2, retaining plate 24 is spaced from the end of core 22 so that core 22 projects from the righthand side of spool 20 the purpose of which will hereinafter be described. Core 22 also includes an axially extending slot 25 projecting radially through its wall the purpose of which will also hereinafter be described.

Figure 3:
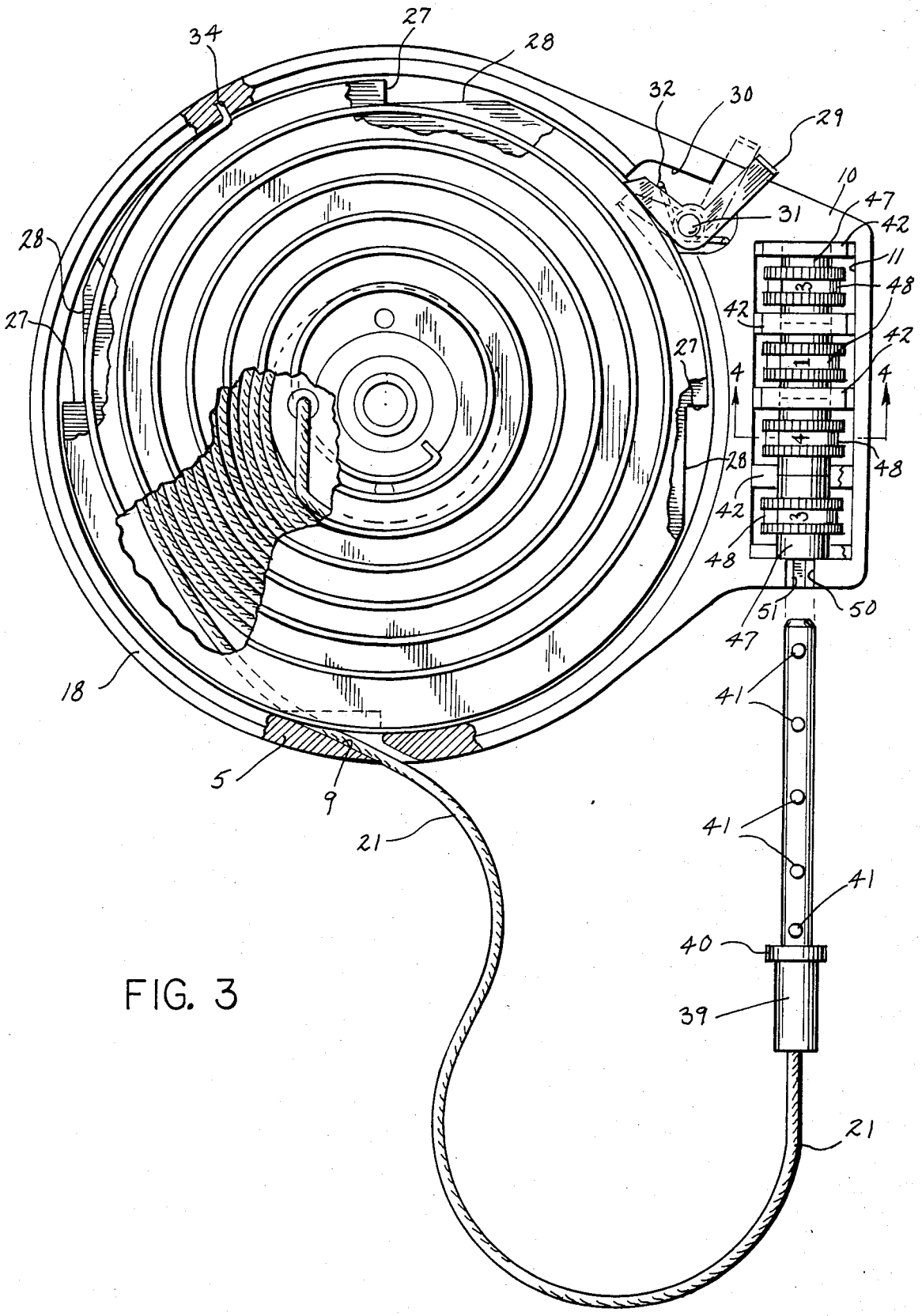
FIG. 3 is a plan view with parts broken away and in section of the retractable cable lock of FIG. 1.

Cable 21 is wound on spool 20, and as shown best in FIG. 3 has one end attached to core 22 and its other end or free end extending through bore 9 in rim 5 of cap member 2. Cable 21 is approximately ⅛ inch thick and about 82 inches long which is sufficient to enable it to lock various items such as skis, bikes, luggage, garments, and the like together. In order to accommodate these dimensions for cable 21, the casing is approximately ½ inch thick by about 3 inches in diameter. Thus, the device is small, portable, and hand-holdable and may be carried in a pocket, purse or other convenient place. Cable 21 may be composed of any lightweight and relatively strong material and preferably is composed of a braided metal having a nylon jacket.

As shown best in FIGS. 2 and 3, cable lock 1 also includes latch means for permitting free rotation of spool 20 in one direction to extend cable 21 and for preventing free rotation of spool 20 in its other direction to rewind cable 21. The latch means includes an annular ratchet wheel 26 disposed within cap members 2 and 3 coaxially with spool 20 and central axis 6. The outer diameter of wheel 26 is substantially identical to the outer diameter of plates 23 and 24 of spool 20. The inner diameter of wheel 26 is substantially identical to the outer diameter of core 22 so that wheel 26 is received on core 22 for rotation therewith in a press fit arrangement. Wheel 26 includes four teeth located equal distances apart along its circumference. Each tooth is defined by a radially extending shoulder 27 and a surface 28 extending transversely to shoulder 27.

The latch means for cable lock 1 also includes a pawl member 29 pivotally mounted on cap member 2. Pawl 29 is located within a cutout 30 formed in enlargement 10 of cap member 2, and the pivotal connection of pawl 29 is provided by a pin 31. As shown best in FIG. 3, one end of pawl 29 may extend into the interior of the chamber formed by cap members 2 and 3 to engage shoulders 27 of ratchet wheel 26. The other end of pawl 29 extends outside of cap members 2 and 3 and is actuatable by a user's finger to pivot pawl 29 into or out of engagement with shoulders 27 of ratchet wheel 26. A ratchet spring 32 normally biases pawl 29 into engagement with shoulders 27 of ratchet wheel 26. Spring 32 is a preformed wire member wrapped about pin 31 having one end engaging the side of cutout 30 and its other end engaging the inner end of pawl 29. Thus, as wheel 26 and spool 20 are rotated in a clockwise direction as shown in FIG. 2 the inner end of pawl 29 will travel along the outer circumference of wheel 26 until it meets surface 28. Pawl 29 will then follow surface 28 until it meets shoulder 27 to prevent any further rotation of spool 20 and wheel 26. Thus, in order to rewind cable 21 a user must hold pawl 29 in the position shown in solid lines in FIG. 3. When extending cable 21 the inner end of pawl 29 travels along the outer circumference of wheel 26 so that when wheel 26 and spool 20 are rotated in a counterclockwise direction there is no need for a user to manipulate pawl 29.

A coil spring 33 is located in the chamber formed by cap members 2 and 3 and is located between ratchet wheel 26 and cap member 3. As shown best in FIG. 3, the inner end of spring 33 includes a tab which is received within slot 25 in core 22 of spool 20 so that spring 33 is firmly attached to spool 20. The outer end of spring 33 also includes a tab which is received within a slot 34 formed in rim 5 of cap member 2 so that spring 33 is also firmly attached to cap member 2. Thus, as spool 20 is rotated in a counterclockwise direction as shown in FIG. 3 to extend cable 21 spring 33 is tightened so that upon disengagement of pawl 29 from wheel 26 spring 33 automatically drives spool 20 in a clockwise direction to rewind cable 21 thereon.

As shown in FIG. 2, an annular separator plate 35 is interposed between spring 33 and ratchet wheel 26. The outer diameter of plate 35 is substantially identical to the outer diameter of wheel 26 and plates 23 and 24 of spool 20, and its inner diameter is substantially identical to the outer diameter of core 22. Thus, plate 35 is disposed coaxially with spool 20, wheel 26, spring 33 and central axis 6.

Cable lock 1 also includes means for reducing friction between the various components described above as spool 20 rotates within cap members 2 and 3. In order to accomplish this, cable lock 1 includes a pair of thin, annular discs 36 and 37 disposed on either side of spool 20. Disc 36 is located between plate 23 of spool 20 and base plate 4 of cap member 2 while disc 37 is located between ratchet wheel 26 and separator plate 35. Both discs 36 and 37 are positioned coaxially with central axis 6 and have a diameter substantially equal to that of plates 23 and 24, wheel 26 and separator plate 35. Disc 36, however, has an inner diameter substantially equal to the outer diameter of boss 7 so that it is received thereon for free rotation thereabout. Disc 37 on the other hand has an inner diameter substantially equal to the outer diameter of core 22 and is received thereon for free rotation thereabout.

A case nut 38 is employed in order to assemble the various components described above as shown in FIG. 2. Nut 38 is an annular washer-like device having internal threads which engage the threads of stud 8 so that when turned down it forces rim 14 to bear against shoulder 18 of rim 5 so that cap members 2 and 3 are securely held together.

Lock means is employed to lock the free end of cable 21 to the casing of cable lock 1. The lock means includes tumbler means disposed within rectangular recess 11 in enlargement 10 of cap member 2, and an elongate member 39 attached to and extending coaxially from the free end of cable 21. As shown, member 39 includes a flange 40 and a plurality of aligned spaced apart lugs 41 thereon projecting transversely to the longitudinal axis of cable 21. Lugs 41 are adapted to cooperate with the tumbler means for locking the elongate member 39 and consequently cable 21 in the casing of cable lock 1. In order to accomplish this, the tumbler means includes a plurality of tumbler bearings 42 and tumblers 43. Each bearing 42 includes a central opening 44 and a rectangular portion 45. Portion 45 engages the bottom of recess 11 and the underside of enlargment 15 of cap member 3 in order to hold the bearing 42 in position. Each pair of adjacent bearings 42 supports a tumbler 43 therebetween as shown best in FIG. 3.

Figure 4:
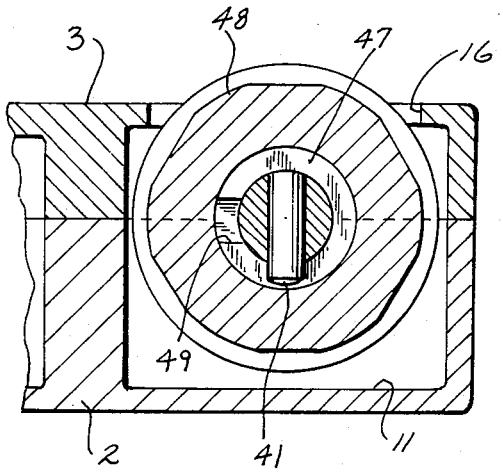
FIG. 4 is a fragmentary sectional view in elevation taken along the plane of the line 4—4 in FIG. 3 illustrating a tumbler in its locking position.
Figure 5:
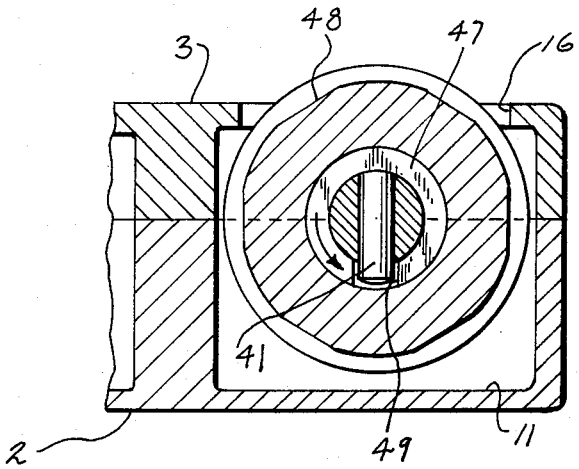
FIG. 5 is a fragmentary view similar to FIG. 4 illustrating the tumbler rotated to its unlocking position.

Each tumbler includes a cylindrical core 47 and a flange-like body 48 centrally located between the end of core 47 projecting through a corresponding slot 16 formed in enlargement 15 of cap member 3. As shown best in FIG. 3, each body 48 includes a plurality of indicia thereon and has a pair of knurled outer rims to aid the user in rotating tumblers 43. As shown in FIGS. 4 and 5, each core 47 includes a radially extending bore 49 formed therein having a diameter slightly greater than the diameter of lugs 41 on elongate member 39. As shown in FIG. 3, the central longitudinal openings in cores 47 are coaxially aligned with the opening formed by bores 17 and 50 extending through the side of enlargements 10 and 15. The diameters of cores 47 are substantially equal to the outer diameter of elongate member 39 so that they may receive elongate member 39. Additionally, tumblers 43 are spaced apart so that the spacing between bores 29 is identical to the spacing between lugs 41 on elongate member 39. Thus, when all of the bores 49 in tumblers 43 are aligned in a downward direction elongate member 39 may be slid through the opening in the side of the casing into tumblers 43. Then, upon rotation of one or all tumblers so that bores 49 no longer align with lugs 41 elongate member 39 is locked within the casing of cable lock 1. To remove elongate member 39 or unlock cable 21 all of the tumblers 43 must be rotated to a position wherein their bores 49 are extending downwardly to align with lugs 41 whereupon elongate member 39 may be removed therefrom.

In operation, one need merely pull on cable 21 and extend cable 21 to the desired position whereupon pawl 29 engages a shoulder 27 to automatically hold cable 21 in this position. Then, the user merely extends the free end of cable 21 through a sleeve of a garment, around a bar of a coat rack, and then insert elongate member 39 within tumblers 43 and rotate one or more of tumblers 43. To unlock the device and remove the garment, the user merely rotates tumblers 43 to the predetermined combination wherein bores 49 are aligned with lugs 41 on elongate member 39 so that elongate member 39 may be removed. Then, the user pivots pawl 29 out of engagement with shoulders 27 of ratchet wheel 26 and spring 33 automatically rewinds cable 21 on spool 20.

A retractable cable lock has been illustrated and described for use as a multi-purpose lock for bikes, skis, luggage, garments and many other items for quick and easy theft resistant locking. The lock is lightweight, compact, portable, hand-holdable and inexpensive to manufacture.

Various modes of carrying out the invention are contemplated as being within the scope of the following claims particularly pointing out and distinctly claiming the subject matter which is regarded as the invention.

I claim:

1. A portable, hand-holdable, retractable cable lock, comprising:

a casing that defines an annular chamber, said casing includes a pair of annular cup-shaped cap members each having a base plate and a circumferential rim projecting from one side thereof, one of said rims including an annular shoulder for receiving said other rim in interfitting engagement therewith, one of said cap members further including a circular boss projecting from said one side into said chamber, said boss includes a threaded stud of lesser diameter than said boss projecting coaxially therefrom;

a spool disposed in said chamber within said casing, said spool including a cylindrical core and a pair of opposing spaced apart annular retaining plates thereon, said core receives said boss therein to provide free rotational movement of said spool relative to said casing, and includes a coaxial cylindrical portion projecting from one of said retaining plates;

an extendable cable wound on said spool having one end attached to said core and its other end extending through the rim of one of said cap members;

latch means for permitting free rotation of said spool in one direction to extend said cable and for preventing free rotation of said spool in its other direction to rewind said cable, said latch means includes:

an annular ratchet wheel disposed within said casing coaxially with said spool, said ratchet wheel attached to said core for rotation therewith, a pawl member pivotally mounted on said casing having one end extending within said casing to engage said ratchet wheel and its other end extending outside of said casing, and a ratchet spring for normally biasing said one end of said pawl into engagement with said ratchet wheel;

first and second friction-reducing annular thin discs disposed coaxially with said spool in said chamber within said casing, said first disc located between said spool and said one cap member and mounted for free rotation on said boss, and said second disc located between said ratchet wheel and said other cap member and mounted for free rotation on said projecting cylindrical portion of said core;

case securing means threadedly engageable with said stud to bear against said other cap member and securely hold said cap members together;

locking means for locking said other end of said cable to said casing, said locking means includes tumbler means within said casing, and an elongate member attached to and extending coaxially from said other end of said cable having a plurality of aligned spaced apart lugs thereon projecting transversely to the longitudinal axis of said elongate member, said lugs adapted to cooperate with said tumbler means for locking said elongate member in the casing;

a coil spring disposed in said chamber within said casing between said second disc and said other cap member, said coil spring having one end attached to said projecting cylindrical portion of said core and its other end attached to said casing so that when said cable is unlocked and in an extended position said coil spring rotates said spool to rewind said cable thereon upon disengagement of said pawl from said ratchet wheel; and an annular separator plate disposed in said chamber within said casing coaxially with said spool and located between said second disc and said coil spring, and mounted for free rotation on said projecting portion of said core.

* * * * *